US008087551B2

(12) United States Patent
Henley, II

(10) Patent No.: US 8,087,551 B2
(45) Date of Patent: Jan. 3, 2012

(54) TOOL FOR DEACTIVATING SMALL ARMS

(76) Inventor: John B. Henley, II, Wasilla, AK (US)

( * ) Notice: Subject to any disclaimer, the term of this patent is extended or adjusted under 35 U.S.C. 154(b) by 738 days.

(21) Appl. No.: 12/150,798

(22) Filed: May 1, 2008

(65) Prior Publication Data

US 2011/0056110 A1 Mar. 10, 2011

Related U.S. Application Data

(60) Provisional application No. 60/927,074, filed on May 1, 2007.

(51) Int. Cl.
*F41C 27/00* (2006.01)

(52) U.S. Cl. ..... 222/386; 222/129; 222/325; 222/145.1; 222/192; 42/70.01; 42/70.11; 42/90; 42/106; 206/219

(58) Field of Classification Search ..... 222/192, 222/386, 129, 135–137, 145.1, 145.5, 145.6, 222/325–327, 384; 42/70.01, 70.11, 90, 42/106; 141/100, 105, 106; 206/219, 220
See application file for complete search history.

(56) References Cited

U.S. PATENT DOCUMENTS

| | | | | |
|---|---|---|---|---|
| 2,094,423 | A * | 9/1937 | Bernhardt | 222/384 |
| 4,373,285 | A * | 2/1983 | Grout et al. | 42/90 |
| 6,089,407 | A * | 7/2000 | Gardos | 222/137 |
| 6,148,557 | A * | 11/2000 | Lindskog et al. | 42/70.01 |
| 6,615,528 | B1 * | 9/2003 | Lindskog et al. | 42/70.01 |
| 6,929,623 | B2 | 8/2005 | Stone | |

* cited by examiner

*Primary Examiner* — J. Casimer Jacyna
(74) *Attorney, Agent, or Firm* — Wood, Phillips, Katz, Clark & Mortimer

(57) ABSTRACT

A device and method for deactivating firearms is described herein. The device includes a casing having a nozzle and a plunger for dispensing a bonding material out of the nozzle. The device is inserted into the barrel of a weapon, and the material is injected into the barrel near the bolt face of the weapon. The bonding material enters the working mechanism of the firearm and hardens, interfering with operation of the firearm.

3 Claims, 4 Drawing Sheets

60
61
62
65
66
27
25
24
37
35
30
20
57
26
10
50
40c
23
2
2
40a
21

21
20
40b
40a
40c

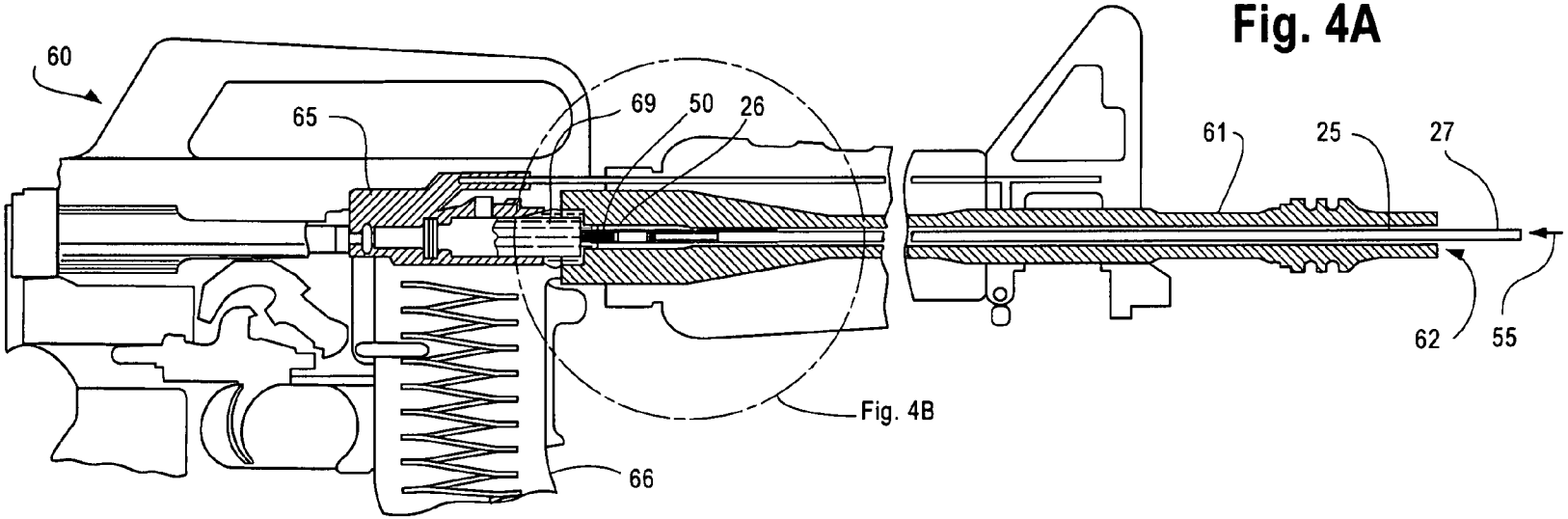
Fig. 4A
55
27
62
25
61
Fig. 4B
26
50
69
66
65
60
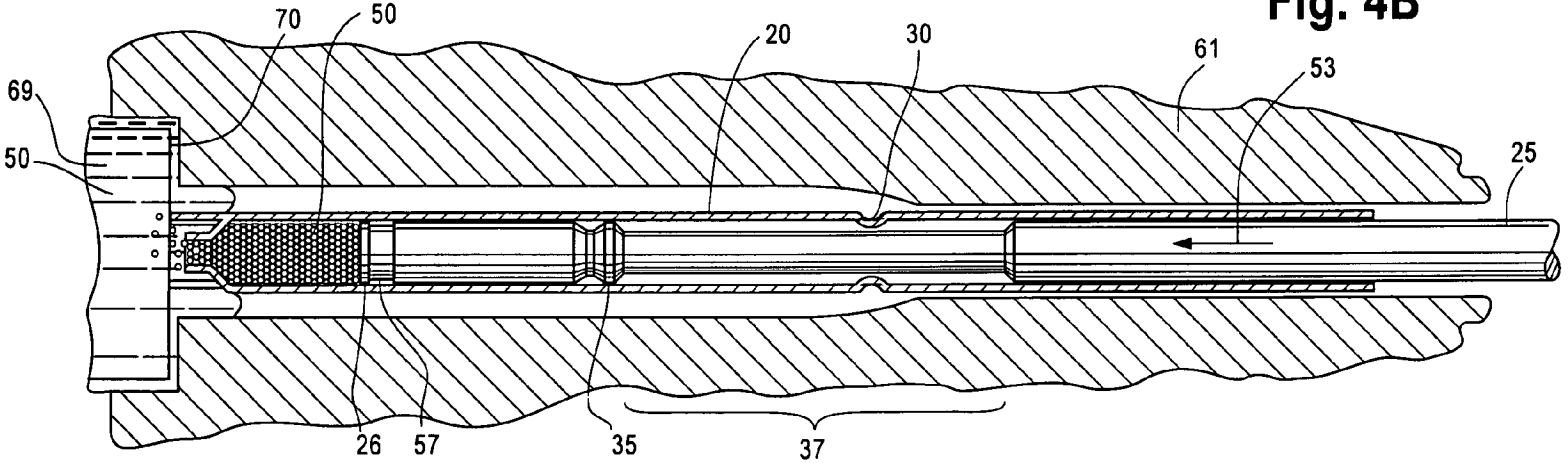
Fig. 4B
25
53
61
30
20
37
35
57
26
50
70
69
50

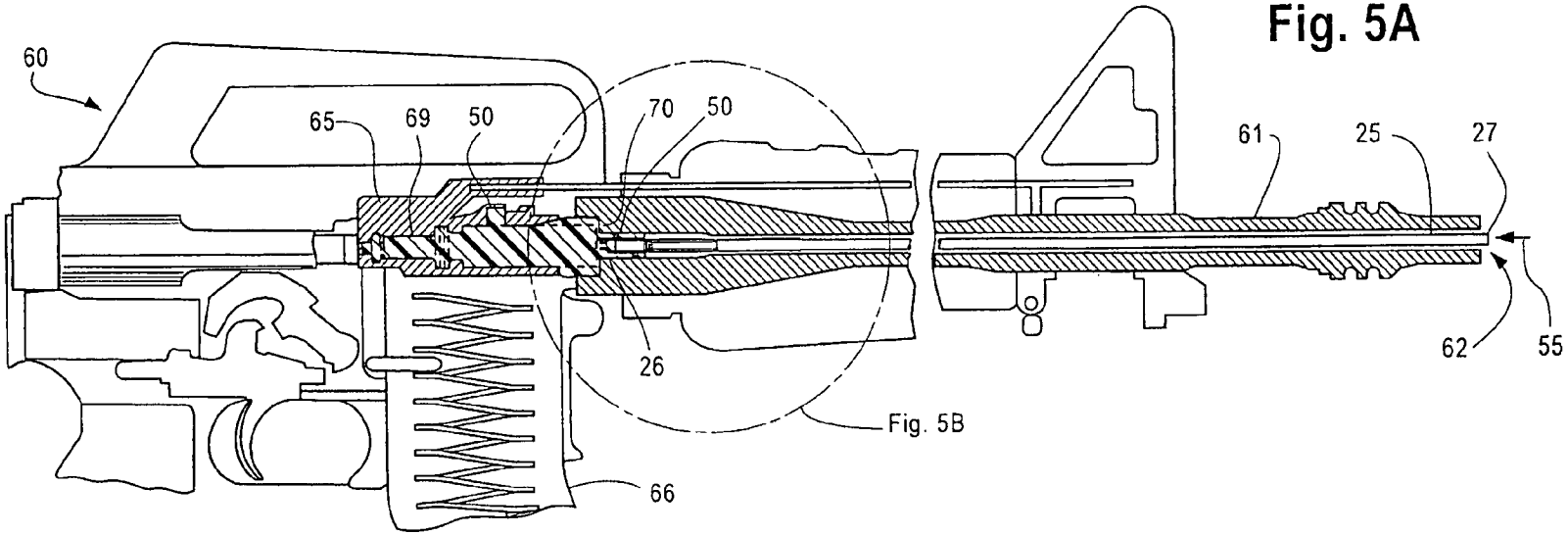
Fig. 5A
55
27
62
25
61
Fig. 5B
50
70
26
66
50
69
65
60
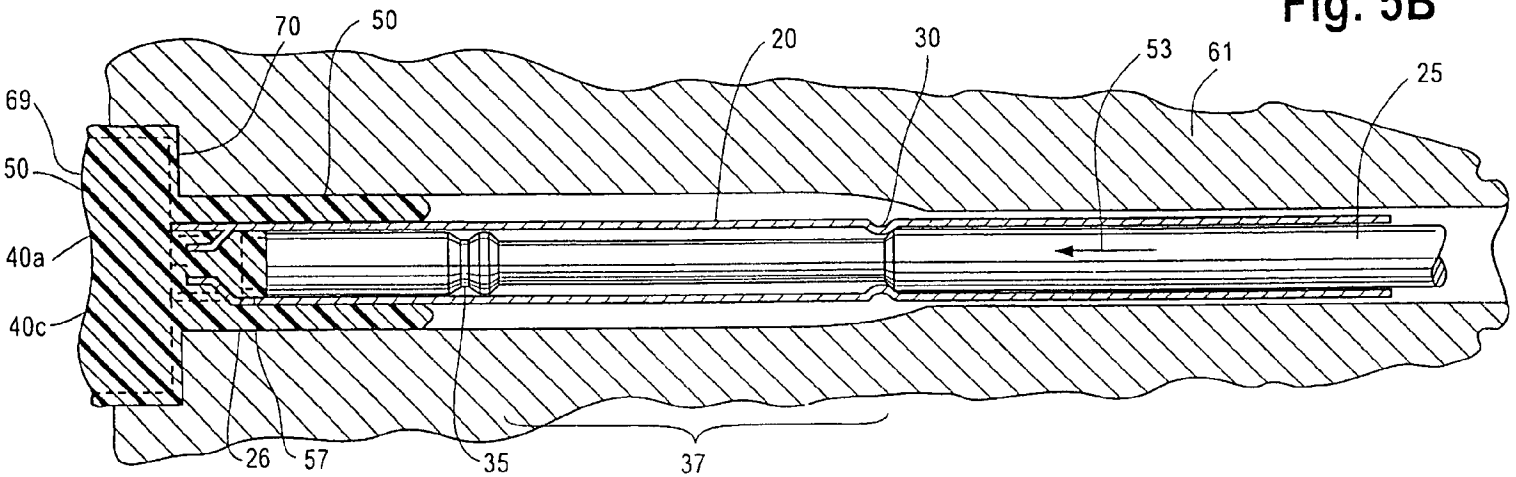
Fig. 5B
25
61
53
30
20
37
35
50
70
57
26
69
50
40a
40c

TOOL FOR DEACTIVATING SMALL ARMS

FIELD OF THE INVENTION

This invention relates to the area of fire arms, and more specifically, disabling small arms in the field. The device described herein renders a small arm such as a rifle, pistol, or other weapon, incapable of chambering or firing a round of ammunition.

BACKGROUND OF THE INVENTION

In times of war, during port or shipboard inspections, and police actions, the military, Homeland Security, or Customs Security Officers are often confronted with the need to carry off, guard, disable, or destroy illegally imported or captured weapons, particularly small arms. The need may arise when weapons are seized individually, or when the weapons are located in stockpiles, caches or shipping containers. While guarding the captured weapons is an option, guarding is manpower intensive and occupies the time of a well trained soldier, Customs, or Homeland Security Officer who's skills and training may be better used elsewhere. Often, the weapons must eventually be disposed of in some manner, often at yet another location, requiring further manpower to guard, transport, and destroy the weapon.

While small arms can be rendered inoperable by application of force, such as crushing, or by the application of sufficient heat to melt or bend the working components of the weapon, equipment, facilities, skills, and manpower are often unavailable to use these methods in battlefield conditions, aboard ships, or at Ports of Entry. Thus, the need exists to easily disable small arms with the limited manpower, limited skills, and limited equipment typically available under conditions found in the field, or at Ports of Entry.

SUMMARY OF THE INVENTION

The invention disclosed herein is a field tool to render inoperable or deactivate small arms. In the most preferred embodiment, the invention is a single use injection device similar to a syringe that allows a user to place a bonding material such as an adhesive or epoxy into the barrel, breach, receiver, or other working parts of the weapon. Once in place, the bonding material can interfere with the operation of the firing pin, extractor, bolt, magazine, and other moving components of the weapon, as well as physically occupying or plugging the breach or barrel of the weapon so that a round cannot be chambered. Further, the field tool can be left in the barrel of the weapon after use and thus bonded in place, providing a ready indicator that the weapon has been rendered inoperable.

The field tool or applicator is readily transportable and simple to operate, thus allowing the device to be carried into the field and used by personnel with minimal training. The use of the device involves clearing the weapon of ammunition, placing an empty magazine into the receiver, moving the bolt to close the breach of the weapon, inserting the applicator into the muzzle of the weapon until the bolt face is in contact with the applicator, and pushing the plunger to dispense the bonding material into the workings of the weapon. Should the bolt be missing from the weapon, or not in the closed position, the device can still be used, however the performance may be diminished.

Similarly, the device will also work without the magazine being in place. If the magazine is not in place, the bonding material can still seep into the receiver, thereby obstructing insertion of a magazine. Even if a magazine can be inserted, the bonding material may also foul or bind the magazine locking mechanism so that the magazine cannot remain in the receiver. This obstructing and binding can occur in addition to the obstruction of the breach and fouling and bonding of other parts the weapon.

BRIEF DESCRIPTION OF THE DRAWINGS

FIG. 4A is a cross-sectional view of the small arm with the field tool inserted into the barrel, the field tool partially dispensing material into the workings of the weapon.

FIG. 4B is a close-up view of the field tool dispensing material into the barrel and around the bolt of the small arm.

FIG. 5A is a cross-sectional view of the small arm with the field tool inserted into the barrel, the field tool having dispensed product into the workings of the small arm.

FIG. 5B is a close-up view of the field tool completing dispensing of the material into the barrel of the small arm.

DETAILED DESCRIPTION OF THE PREFERRED EMBODIMENT

Figure 1:
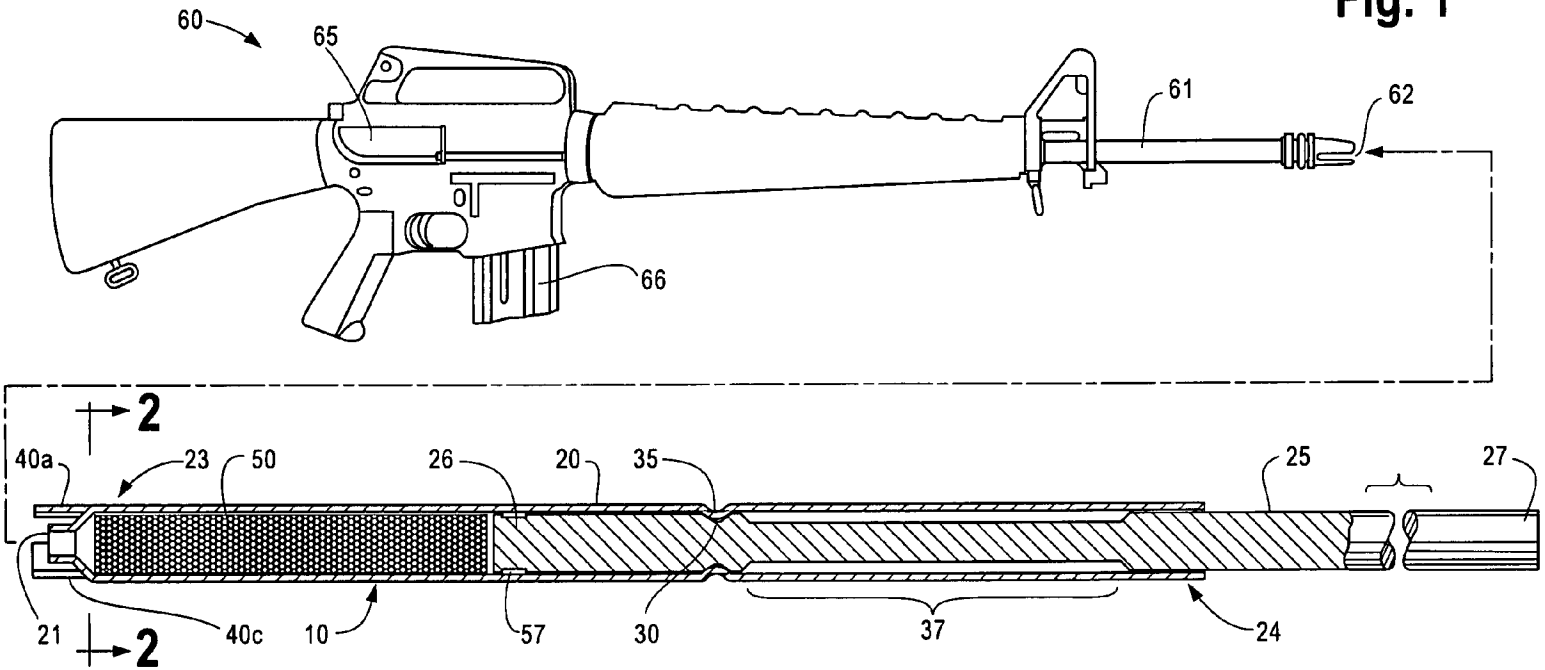
FIG. 1 is a diagram showing a small arm and a cross-sectional view of the field tool of the present invention.
Figure 2:
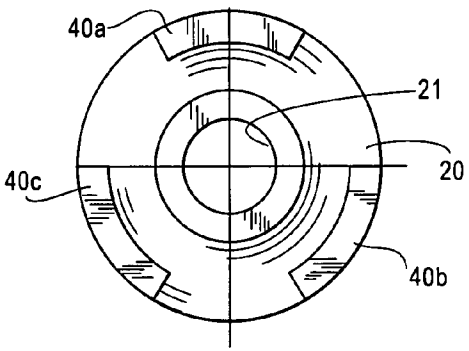
FIG. 2 is an end elevational view of the nozzle end of the field tool.

As shown in the Figures, the field tool 10 of the preferred embodiment is a generally cylindrical casing 20 preferably having a wall thickness of approximately two hundredths of an inch thick. The casing 20 is approximately three inches long. The casing 20 includes a port or nozzle 21 at a first end 23, and an opening to accept a plunger 25 at a second end 24, the plunger 25 extending coaxially and slidably within the casing 20. When the plunger 25 slides toward the nozzle 21, material 50 is dispensed out of the nozzle 21. The nozzle 21 is approximately 0.0625 inches in diameter. The casing 20 is approximately 0.2 inches in diameter, to allow the casing to fit into the barrel of weapons as small as .22 caliber.

One skilled in the art will recognize that larger diameter casings can be used for larger caliber weapons. For instance, the casing is preferably 0.3 inches in diameter when designed for use with .40-.50 caliber weapons. The larger diameter casing 20 allows more material to be injected into the larger caliber weapons, and reduces the clearance between the wall of the casing 20, and the wall of the barrel 61. Additionally, one will recognize that the dimensions set forth herein are only preferences and may be varied.

The first end 23 of the casing 20 also includes stand-offs 40*a-c*, which extend beyond the opening of the nozzle 21 by approximately 0.04 inches. The stand-offs 40*a-c* may extend beyond the nozzle 21 by other amounts. Although the preferred embodiment shows three stand-offs, one skilled in the art will recognize that the number of stand-offs can vary, so long as the structure displaces the nozzle 21 from the bolt face 70. The stand-offs 40*a-c* are placed against the bolt face 70 when the field tool 10 is inserted into the barrel 61 of a small arm 60, as shown in FIGS. 3A-5A. The stand-offs 40*a-c* allow the nozzle 21 to be displaced from the bolt face 70, allowing material 50 to freely flow out of the nozzle 21 and into the workings of the small arm 60. The displacement from the bolt face 70 also allows the material 50 to occupy the space between the bolt face 70 and the nozzle 21, thereby forming a plug of material 50. The plug of material 50 will remain in the barrel 61 even if the field tool 10 is removed from the barrel 61.

The plunger 25 includes a plunger first end 26 and a plunger second end 27. Between the plunger first end 26 and the plunger second end 27 is a circumferential groove 30 which engages a circumferential bulge 35 that extends inwardly from the wall of the casing 20 into the interior of the casing 20. One skilled in the art will recognize that the groove 30 and protrusion 35 need not extend about the entire circumference of the casing 20 or plunger 25. When so engaged, the plunger 25 is fixed in position relative to the casing 20 and movement of the plunger 25 within the casing 20 is restrained, unless sufficient force is applied to overcome the engagement. Plunger 25 also includes an area of reduced diameter 37, which allows the plunger 25 to pass by the circumferential protrusion 35 when the field tool 10 is activated by applying force to move the plunger 25 toward the nozzle 21.

The material 50 dispensed through nozzle 21 when plunger 25 is pushed forward can be a two part epoxy that will mix as the plunger 25 is moved towards the nozzle 21. Such two part epoxies typically have a resin and activator or hardener that activate when mixed together. Such two part epoxies are manufactured by J-B Weld Company of Sulpher Springs Tex. The epoxies are available in a number of formulations having different working times, and bonding properties. Those having superior bonding to metal surfaces are preferred. Resistance to solvents is also preferred to hamper cleaning or repair of the deactivated weapon. It is preferred that the epoxy have a working time of 30 minutes or less. In alternate embodiments, the material 50 may be a single part bonding material such as a polyurethane adhesive, which will not need mixing.

One part of the epoxy, typically the hardener, can be encased in glass or plastic beads, the beads being suspended in the second part, or resin. Alternatively, each part of a two part epoxy can be encased or suspended in plastic or glass structures such as packets, tubes, beads, or other suitable structures that will keep the parts separated prior to use. Such structures however, must rupture or otherwise allow the two parts of the binary material to mix when the plunger 25 moves towards the nozzle 21. One skilled in the art will recognize arrangements other than glass or plastic beads can be used to store and activate binary materials in the present invention.

In operation, as shown in FIG. 3A through 5B, the field tool 10 is inserted nozzle 21 first into the barrel 61 of the weapon 60 by way of the muzzle 62. The plunger 25 of the field tool 10 is typically 30 inches in length, to accommodate common barrel lengths of standard small arms, typically of 28-30 inches. One skilled in the art will recognize that other length plungers 25 can be used to accommodate weapons with shorter or longer barrels.

Figure 3A:
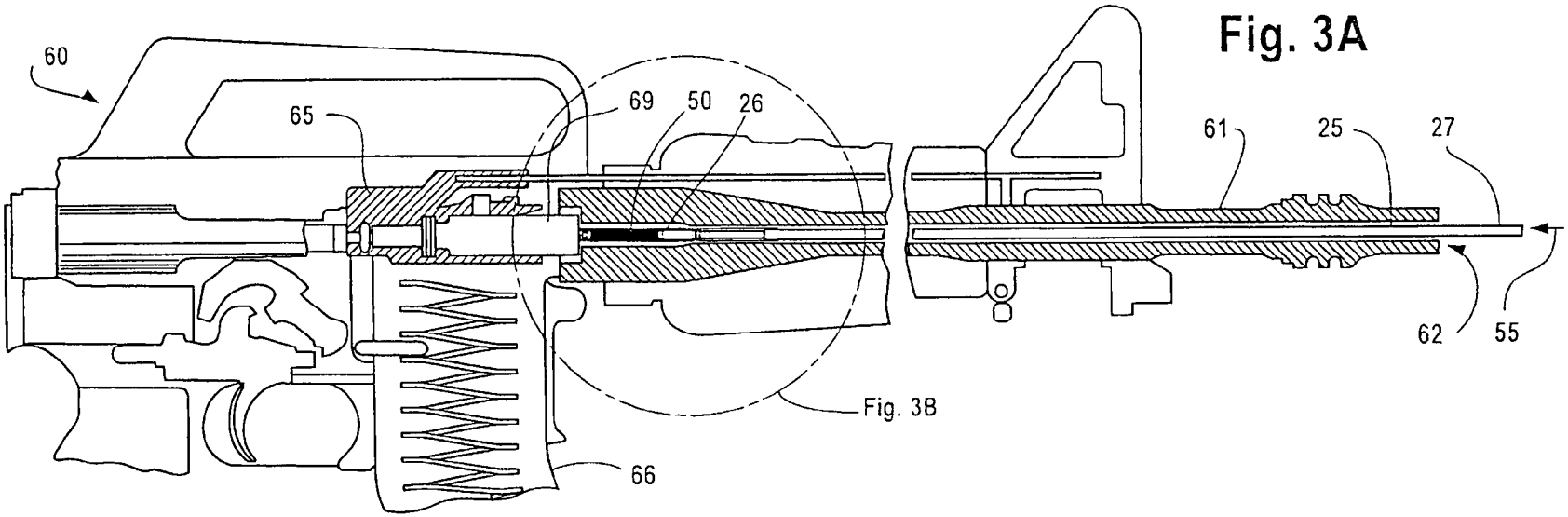
FIG. 3A is a cross-sectional view of a small arm with the field tool inserted into the barrel of the weapon.
Figure 3B:
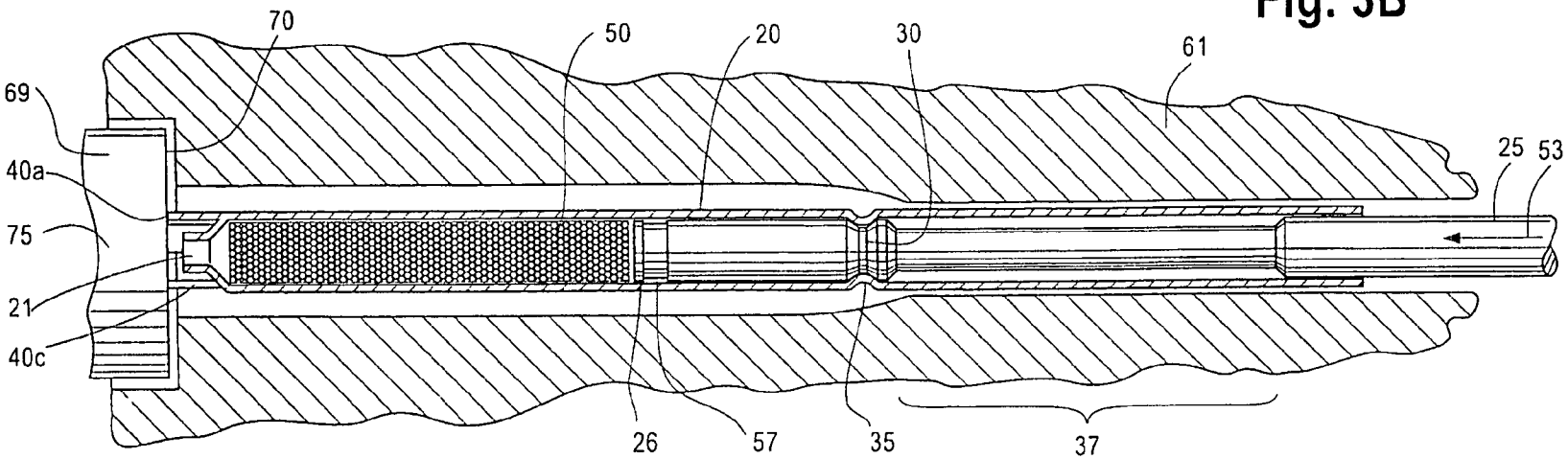
FIG. 3B is a close-up cross-sectional view of the field tool in the breach end of the weapon.

As shown in FIG. 3, the field tool 10 is inserted into the barrel 61 so that the stand-offs 41*a*-41*c* rest against the bolt face 70. The plunger second end 27 extends out the muzzle 62 of the barrel 61. To use the field tool 10, the plunger second end 27 is pressed in the direction of arrow 55, which is a direction towards the nozzle 21. Such force dislodges circumferential groove 30 from the circumferential protrusion 35, allowing the plunger first end 26 to force material 50 out of nozzle 21, and into the barrel 61 of the small arm 60.

As the material 50 exists nozzle 21, it backfills into the barrel 61, and penetrates around the bolt 69 and into the receiver area of the weapon 60, wherein the material 50 contacts other workings of the weapon 60, and will lock the bolt 69 in place, preventing removal of the bolt 69 or movement of the bolt 69 or chambering of a round of ammunition. The material 50 may also inhibit the operation of the firing pin 75 within bolt 69 and may also interfere with extractors and other components of the bolt 69.

If a magazine 66 is in the weapon or small arm 60, the material can enter the magazine 66, or the magazine locking mechanism, preventing removal of the magazine 66 from the small arm 60. While it is preferred an magazine 66 is in the weapon prior to the use of the field tool 10, if a magazine 66 is not present, the material 50 can still interfere with the magazine locking mechanism such that a magazine 66 cannot be inserted into or retained in the small arm 60.

As shown in FIG. 5, the plunger 25 is advanced through to the end of the area of reduced diameter 37, wherein further movement of the plunger 25 is restricted by circumferential protrusion 35, which does not allow the wider portion of the plunger 25 to pass. This limitation in movement prevents the plunger 25 from completely ejecting material 50 from the casing 20. The material 50 remaining within the casing 20, and extending out through the nozzle 21 mechanically fixes or adheres the casing 20 in the barrel 61 when material 50 hardens. Further, the first end 26 of the plunger 25 can include an area of reduced diameter 57 which can fill with material 50 as plunger 25 is advanced into the casing 20. This area provides mechanical adhesion so that plunger 25 cannot be removed from casing 20 when material 50 hardens.

The method and structure described herein are merely examples of how the invention can be constructed and used. Such examples are not meant to limit the scope of the invention.

What is claimed is:

1. A device for disabling a firearm, the device having a casing containing an expellable material, the casing including a plunger receiving end and a nozzle end having a nozzle, the plunger receiving end of the casing receiving a plunger, the plunger being slideable within the casing and having a first end for pushing material within the casing out of the nozzle as the plunger first end moves within the casing and a second end for manipulation by a user, the plunger including a groove between the plunger first end and second end, the groove engaging a protrusion on the casing, the nozzle end including stand offs that extend axially beyond the nozzle, wherein the material is a binary material that hardens when mixed together.

2. A device for disabling a firearm, the device having a casing containing an expellable material, the casing including a plunger receiving end and a nozzle end having a nozzle, the plunger receiving end of the casing receiving a plunger, the plunger being slideable within the casing and having a first end for pushing material within the casing out of the nozzle as the plunger first end moves within the casing and a second end for manipulation by a user, the plunger including a groove between the plunger first end and second end, the groove engaging a protrusion on the casing, the nozzle end including stand offs that extend axially beyond the nozzle, wherein the material is a two-part epoxy that mixes when the plunger moves toward the nozzle.

3. The device of claim 2, wherein one part of the two-part epoxy is suspended in a rupturable structure.

* * * * *